US010227213B2

(12) United States Patent
Fauconnet et al.

(10) Patent No.: US 10,227,213 B2
(45) Date of Patent: Mar. 12, 2019

(54) HANDRAIL USED TO OPEN AND CLOSE ELEVATOR CAR PANELS

(71) Applicant: Otis Elevator Company, Farmington, CT (US)

(72) Inventors: Aurelien Fauconnet, Isdes (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 106 days.

(21) Appl. No.: 15/468,358

(22) Filed: Mar. 24, 2017

(65) Prior Publication Data

US 2017/0297870 A1 Oct. 19, 2017

(30) Foreign Application Priority Data

Apr. 15, 2016 (EP) ..... 16305447

(51) Int. Cl.
*B66B 11/02* (2006.01)

(52) U.S. Cl.
CPC ..... *B66B 11/0246* (2013.01); *B66B 11/0226* (2013.01); *B66B 11/0253* (2013.01)

(58) Field of Classification Search
CPC ..... B66B 11/0226; B66B 11/0246; B66B 11/0253
See application file for complete search history.

(56) References Cited

U.S. PATENT DOCUMENTS

| | | | | |
|---|---|---|---|---|
| 4,635,756 | A * | 1/1987 | Sherwood | B66B 11/0253 187/401 |
| 4,711,322 | A * | 12/1987 | Orndorff | E04B 9/18 187/401 |
| 6,209,931 | B1 | 4/2001 | Stoutenborough et al. | |
| 6,484,850 | B1 | 11/2002 | Kobayashi et al. | |
| 6,971,686 | B2 | 12/2005 | Becken | |
| 7,404,306 | B2 | 7/2008 | Walls et al. | |
| 7,556,126 | B2 | 7/2009 | Wang | |
| 7,878,034 | B2 | 2/2011 | Alber et al. | |
| 2005/0224299 | A1 | 10/2005 | Soemardjan et al. | |

(Continued)

FOREIGN PATENT DOCUMENTS

| | | | |
|---|---|---|---|
| EP | 1930278 | A1 | 11/2008 |
| EP | 2114810 | B1 | 1/2011 |

(Continued)

OTHER PUBLICATIONS

European Search Report, European Application No. 16305447.1, dated Sep. 29, 2016, European Patent Office; European Search Report 6 pages.

*Primary Examiner* — Michael A Riegelman
(74) *Attorney, Agent, or Firm* — Cantor Colburn LLP

(57) ABSTRACT

An elevator car panel configured to open and methods of opening the same. The elevator car panel includes a handrail configured on a first side of the elevator car panel and a locking mechanism configured on a second side of the elevator car panel, the second side opposite the first side. The handrail is operably connected to the locking mechanism such that movement of the handrail from a first position to a second position operates the locking mechanism to transition from a locked position to an unlocked position and, when in the unlocked position, the elevator car panel is openable.

15 Claims, 7 Drawing Sheets

(56) References Cited

U.S. PATENT DOCUMENTS

| | | | | |
|---|---|---|---|---|
| 2010/0038183 | A1* | 2/2010 | Henseler | B66B 11/0246 187/276 |
| 2012/0104917 | A1 | 5/2012 | Fan | |
| 2012/0255815 | A1 | 10/2012 | Koskelainen | |
| 2015/0167355 | A1 | 6/2015 | Coltel et al. | |
| 2018/0051468 | A1* | 2/2018 | Beauchaud | F21S 4/20 |
| 2018/0222723 | A1* | 8/2018 | Gressien | B66B 5/0087 |

FOREIGN PATENT DOCUMENTS

| | | | |
|---|---|---|---|
| JP | H04338085 | | 11/1992 |
| JP | 2005096962 | | 4/2005 |
| JP | 2011068428 | A | 4/2011 |
| WO | 2015152918 | A1 | 10/2015 |

* cited by examiner

HANDRAIL USED TO OPEN AND CLOSE ELEVATOR CAR PANELS

CROSS-REFERENCE TO RELATED APPLICATIONS

The present application claims priority from European Patent Application No. 16305447.1, filed Apr. 15, 2016. The contents of the priority application are hereby incorporated by reference in their entirety.

BACKGROUND

The subject matter disclosed herein generally relates to elevator car panels and, more particularly, to methods and apparatus for opening and closing elevator car panels.

Elevator lift manufacturers have been required to reduce hoistway or elevator shaft overhead dimensions and pit depth based on safety factors and other considerations. The two dimensions (overhead dimension and pit depth, also referred to collectively as safety volumes) are key characteristics for elevator construction and design. Mechanics currently go to the top of car, or on top thereof, or in the pit, for inspection or maintenance activity of various components of an elevator car. Thus, safety spaces or volumes are employed within the elevator shaft and thus require increased overhead and pit dimensions. The safety volumes of an elevator shaft may impact the dimensions and construction of a building that houses the elevator.

The required dimensions of the safety volumes on the top of the car and in the pit may be increased to provide safety to technicians located in either volume during maintenance, inspection, etc. Accordingly, the hoistway dimensions may be increased, which may not be desirable for overall building construction and design. As such, solutions to ensure the safety of technicians or other persons may be desirable.

SUMMARY

According to one embodiment, an elevator car panel is configured to open. The elevator car panel includes a handrail configured on a first side of the elevator car panel and a locking mechanism configured on a second side of the elevator car panel, the second side opposite the first side. The handrail is operably connected to the locking mechanism such that movement of the handrail from a first position to a second position operates the locking mechanism to transition from a locked position to an unlocked position and, when in the unlocked position, the elevator car panel is openable.

In addition to one or more of the features described above, or as an alternative, further embodiments of the elevator car panel may include that the locking mechanism includes at least one locking pin, the locking pin configured to be engaged with a fixed portion of the elevator car when the locking mechanism is in the locked position and disengaged when the locking mechanism is in the unlocked position.

In addition to one or more of the features described above, or as an alternative, further embodiments of the elevator car panel may include a pivot operably connected to the handrail, wherein the at least one locking pin is operably connected to the pivot.

In addition to one or more of the features described above, or as an alternative, further embodiments of the elevator car panel may include a connector operably connecting the at least one locking pin to the pivot.

In addition to one or more of the features described above, or as an alternative, further embodiments of the elevator car panel may include a securing mechanism configured to secure the handrail in the first position and releasable to enable the handrail to move to the second position.

In addition to one or more of the features described above, or as an alternative, further embodiments of the elevator car panel may include an additional handrail fixedly connected to the elevator car panel.

In addition to one or more of the features described above, or as an alternative, further embodiments of the elevator car panel may include that the elevator car panel includes a first subpanel and a second subpanel, wherein the handrail connected to the locking mechanism is mounted on the first subpanel, and the first subpanel and the second subpanel form a wall of an elevator car.

In addition to one or more of the features described above, or as an alternative, further embodiments of the elevator car panel may include at least one hinge configured to enable the elevator car panel to open when the locking mechanism is in the unlocked position.

In addition to one or more of the features described above, or as an alternative, further embodiments of the elevator car panel may include at least one translating mechanism configured to enable the elevator car panel to open when the locking mechanism is in the unlocked position.

According to another embodiment, a method of opening an elevator car panel is provided. The method includes operating a handrail of an elevator car panel from a first position to a second position and unlocking at least one locking pin of a locking mechanism operably connected to the handrail due to operation of the handrail from the first position to the second position, the at least one locking pin engageable with a fixed portion of the elevator car. The handrail is on a first side of the elevator car panel and the locking mechanism is on a second side of the elevator car panel opposite the first side.

In addition to one or more of the features described above, or as an alternative, further embodiments of the method may include unlocking the handrail prior to operating the handrail from the first position to the second position.

In addition to one or more of the features described above, or as an alternative, further embodiments of the method may include opening the elevator car panel after unlocking the at least one locking pin.

In addition to one or more of the features described above, or as an alternative, further embodiments of the method may include operating the handrail from the second position back to the first position, and locking the at least one locking pin.

In addition to one or more of the features described above, or as an alternative, further embodiments of the method may include that operation of the handrail comprises one of rotation, pushing, pulling, or translating.

In addition to one or more of the features described above, or as an alternative, further embodiments of the method may include that the elevator car panel includes a first subpanel and a second subpanel, wherein the handrail connected to the locking mechanism is mounted on the first subpanel, and the first subpanel and the second subpanel form a wall of an elevator car.

Technical effects of embodiments of the present disclosure include a movable handrail operably connected to a locking mechanism such that movement of the handrail enables unlocking of the locking mechanism to enable opening of an elevator car panel or a portion thereof.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
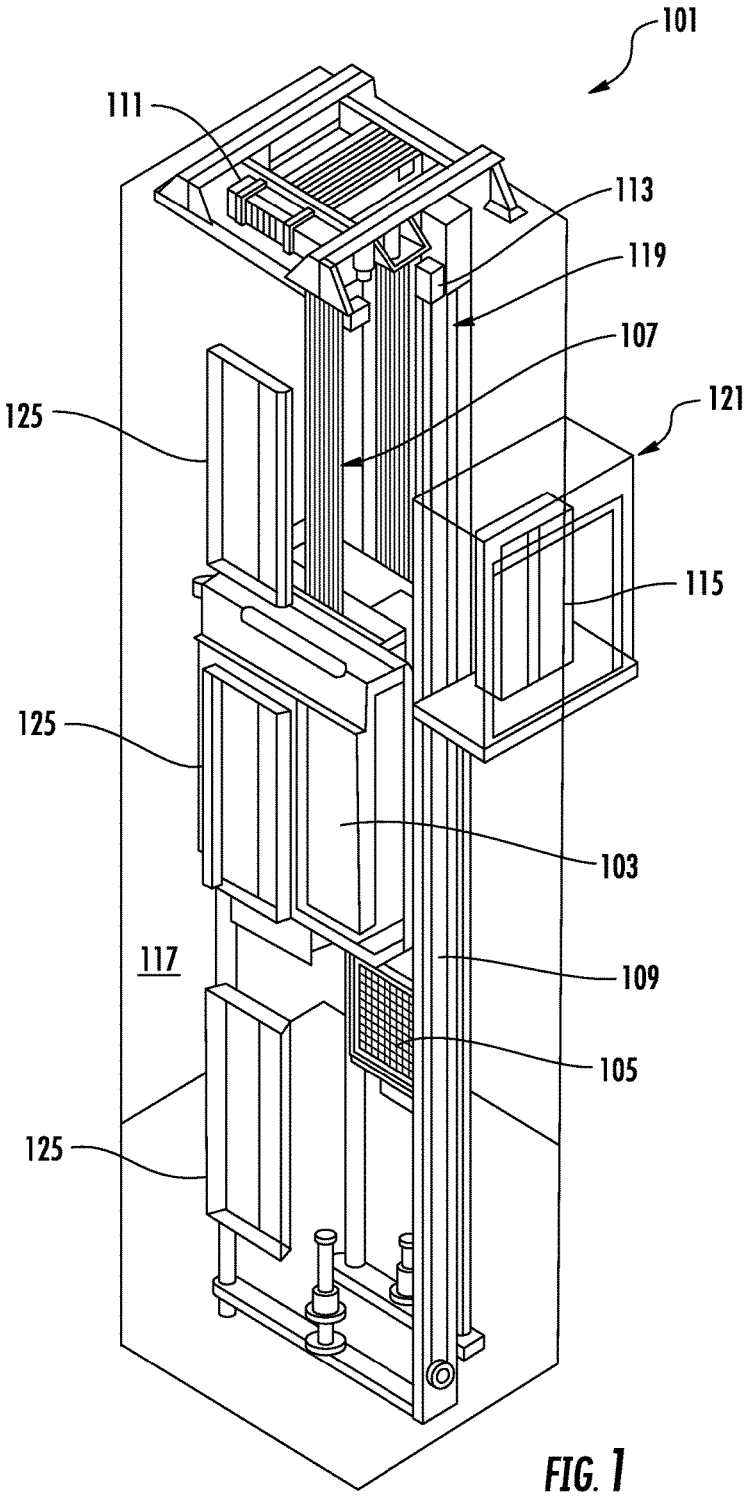
FIG. 1 is a schematic illustration of an elevator system that may employ various embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

At times, it may be necessary for a technician or other person to gain access to elements that are located behind a panel of the elevator car. For example, certain electronics and/or other components of the elevator car are stored behind a panel of the elevator car. Further, it may be necessary for a technician or other person to access exterior components of the elevator, such as governors, guide rails, roping, etc.

Figure 2A:
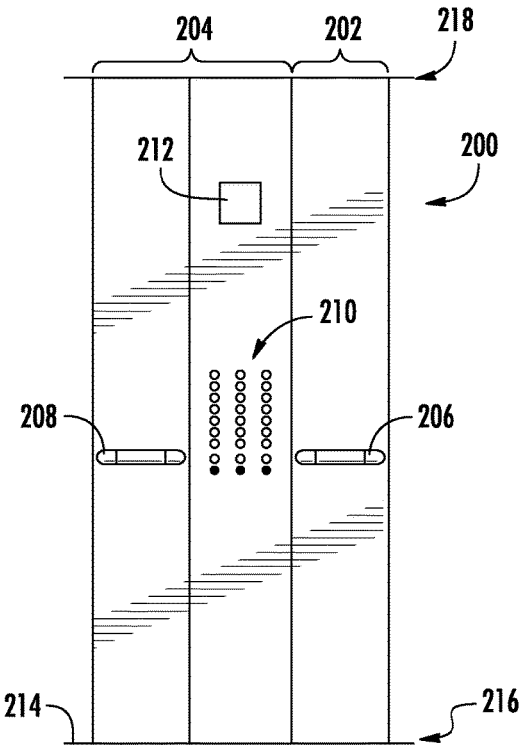
FIG. 2A is a front elevation schematic illustration of an elevator car panel.
Figure 2B:
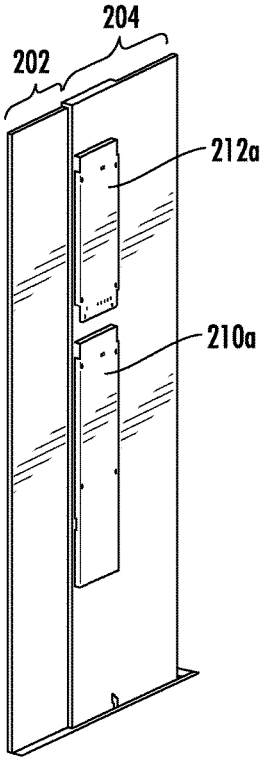
FIG. 2B is a rear perspective schematic illustration of the elevator car panel of FIG. 2A.

Turning to FIGS. 2A and 2B, schematic illustrations of an elevator car panel 200 that may be configured to employ embodiments described herein is shown. FIG. 2A shows a front elevation schematic view of a first side of the elevator car panel 200. FIG. 2B shows a rear perspective schematic view of a second side of the elevator car panel 200. The elevator car panel 200, as shown, includes two subpanels 202, 204, wherein a first subpanel 202 forms about a third of the elevator car panel 200 and the second subpanel 204 forms about two-thirds of the elevator car panel 200. That is, the first subpanel 202 and the second subpanel 204 are configured to form a wall of an elevator car. The two subpanels 202, 204, in some configurations, are parts of a solid or continuous elevator car panel, and thus are fixedly connected or are subparts of a continuous wall.

As shown, the first subpanel 202 includes an associated first handrail 206 on a first side of the first subpanel 202 (e.g., a front or interior side of the first subpanel). Similarly, the second subpanel 204 includes an associated second handrail 208 on a first side of the second subpanel 204 (e.g., a front or interior side of the second subpanel). The handrails 206, 208 are configured within the elevator car, and on the elevator car panel 200, to provide users or passengers of the elevator to have a hand rail to provide support or other function.

Further, as shown, the second subpanel 204 includes an operation or control section 210. The control section 210, as shown, includes a number of buttons that are used to enable a passenger to select a destination floor, and may also include emergency buttons, or other buttons as known in the art. In some embodiments, the control section 210 may be a touchscreen or other type of user-interface display that enables a user or passenger to interact with and/or control the elevator. As shown in FIG. 2B, control section electronics 210*a* are shown on the back side of the second subpanel 204. The control section electronics 210*a* are electronics and other components that are configured to enable the control section 210 to control the elevator car. For example, the control section electronics 210*a* may include switches, processors, communication devices, etc. that enable a passenger to control the elevator car.

Additionally, as shown, the second subpanel 204 includes a display 212. The display 212 is a screen or other light up display that is used to indicate a current floor or movement of the elevator car. In some embodiments, the display 212 can be used to display real-time information (e.g., weather, etc.) and/or may be used to display television, advertisements, etc. As shown in FIG. 2B, display electronics 212*a* are shown on the back side of the second subpanel 204. The display electronics 212*a* may include processors, memory, display components, etc. that enable the display 212 to provide desired information, including current floor, movement, commercials, etc., as noted above.

The elevator car panel 200 extends from a floor 214 at a bottom 216 up to a top 218, which may be a ceiling of the elevator car. In some embodiments, the elevator car panel 200 may be substantially solid. That is, the elevator car panel 200 may be configured to be a wall or other structure that prevents unauthorized persons to gain access to the electronics 210*a*, 212*a*, or other components that may be located behind the elevator car panel 200. As such, as viewed from inside an elevator car, the elevator car panel 200 may appear as a solid wall that may not be opened.

However, at times, it may be necessary to perform maintenance on aspects of the control section 210, the display 212, associated electronics 210*a*, 212*a*, and/or to access other electronics, wiring, components, etc. that are housed behind the elevator car panel 200. Accordingly, providing ease of access and an ability to remove the elevator car panel 200 may be advantageous. However, preventing passengers from intentionally or inadvertently removing the elevator car panel 200 is also important.

Figure 3A:
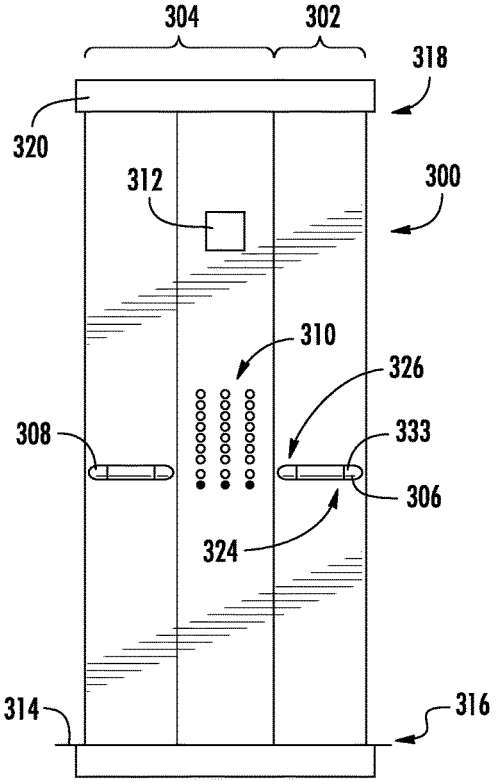
FIG. 3A is a front elevation schematic illustration of an elevator car panel configured in accordance with an embodiment of the present disclosure in a first position.
Figure 3B:
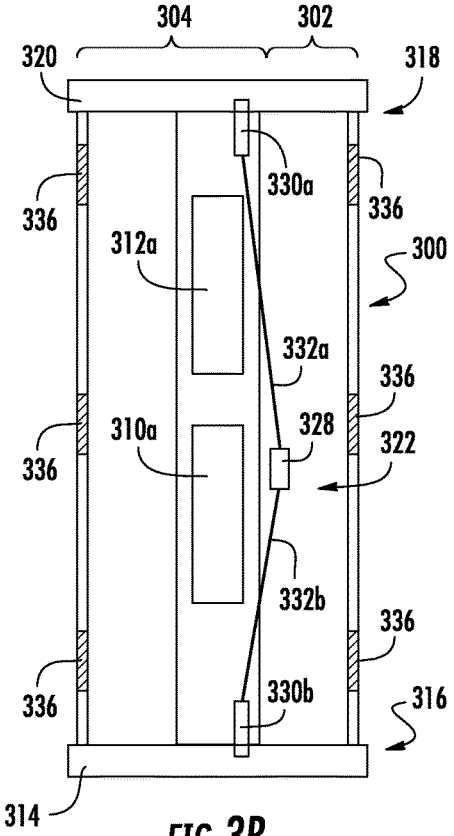
FIG. 3B is a rear elevation schematic illustration of the elevator car panel of FIG. 3A in the first position.
Figure 3C:
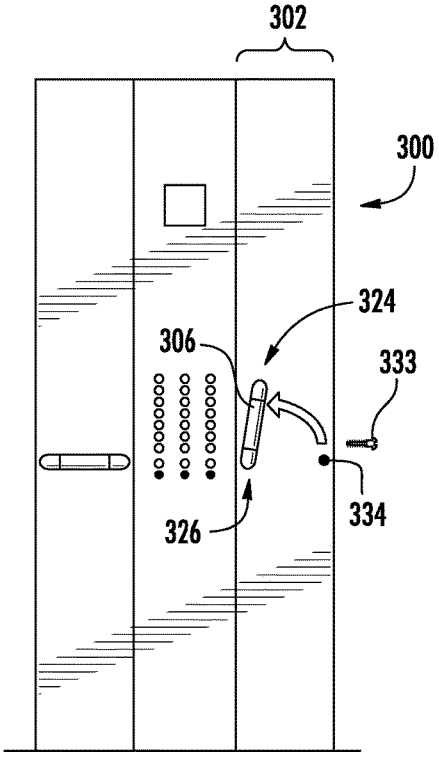
FIG. 3C is a front elevation schematic illustration of the elevator car panel of FIG. 3A shown in a second position.
Figure 3D:
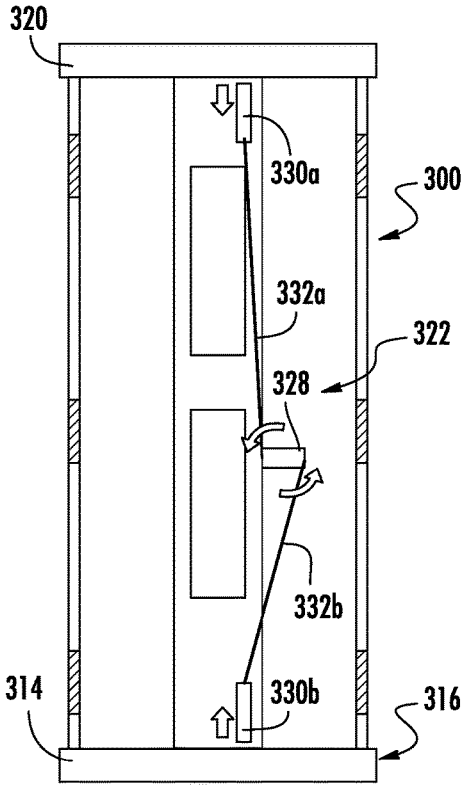
FIG. 3D is a rear elevation schematic illustration of the elevator car panel of FIG. 3A in the second position.
Figure 3E:
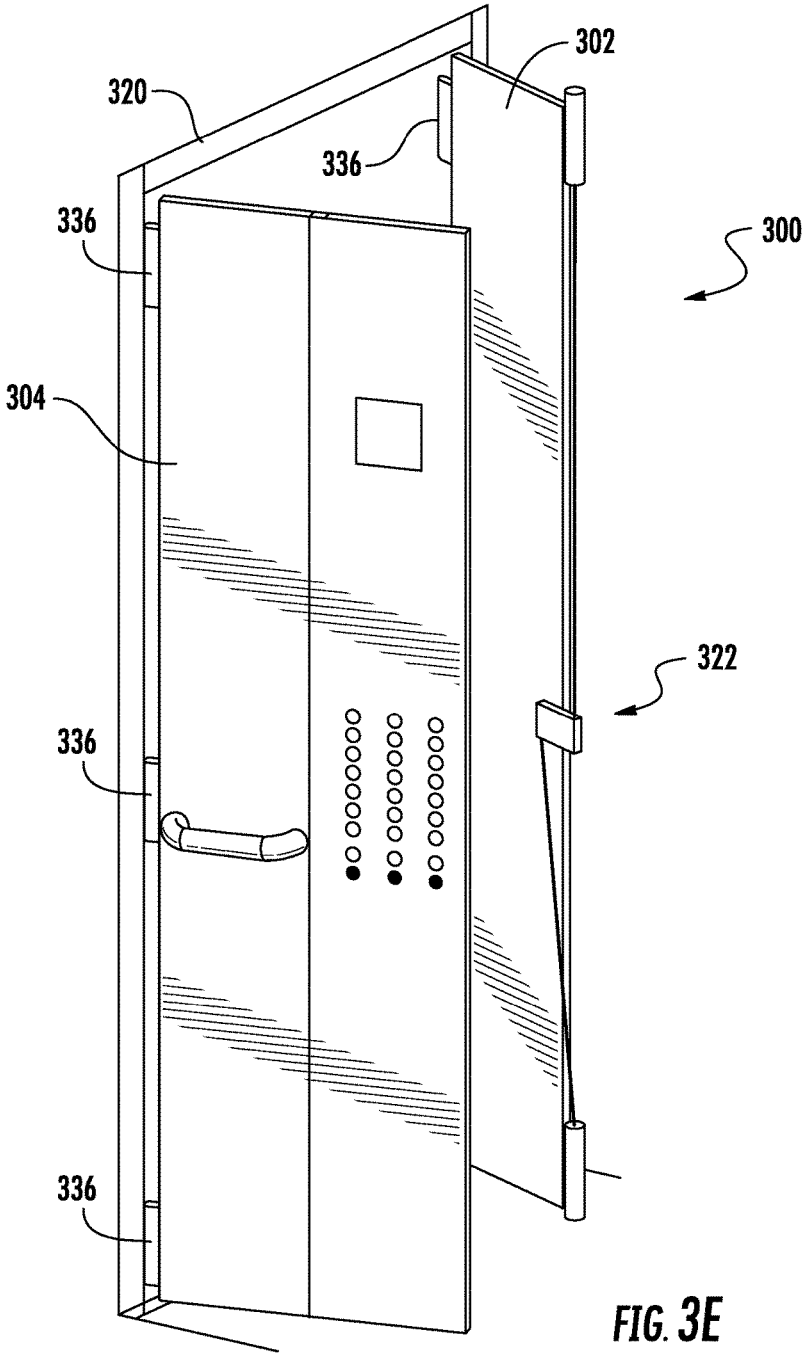
FIG. 3E is a perspective schematic illustration of the elevator car panel of FIG. 3A in a third position.

Turning now to FIGS. 3A-3E, various schematic illustrations of a handrail configuration for opening an elevator car panel are shown. FIG. 3A is a front elevation schematic of a first side of an elevator car panel 300 incorporating an embodiment of the present disclosure, in a first or locked position. FIG. 3B is a rear elevation schematic of a second side of the elevator car panel 300 of FIG. 3A, in the first position. FIG. 3C is a front elevation schematic of the elevator car panel 300 shown in a second or unlocked position. FIG. 3D is a rear elevation schematic of the elevator car panel 300 shown in the second position. FIG. 3E is a perspective schematic illustration of the elevator car panel 300 in a third or open position.

As shown, the elevator car panel 300 is configured similar to that shown in FIGS. 2A-2B. For example, as shown in FIGS. 3A-3B, the elevator car panel 300 includes a first subpanel 302 (with a first handrail 306 on a first side (e.g., front or interior side)) and a second subpanel 304 (with a second handrail 308 on a first side (e.g., front or interior side)). Located on the second subpanel 304 are a control section 310 (and associated electronics 310*a*) and a display 312 (and associated electronics 312*a*). The elevator car panel 300 extends from the floor 314 at the bottom 316 to the ceiling 320 at the top 318.

As shown in FIG. 3B, a locking mechanism 322 is configured on the second side of the elevator car panel 300 (e.g., rear or exterior side). The locking mechanism 322 is configured to enable unlocking of the elevator car panel 300 such that the elevator car panel 300 may be opened and access to the electronics 310*a*, 312*a* and/or other components and/or features behind the elevator car panel 300, including but not limited to exterior components of the elevator such as governors, roping, guide rails, etc. is enabled. The locking mechanism 322 is configured to engage with a fixed portion of the elevator car when in the locked position (e.g., ceiling 320, floor 314, elevator car frame, etc.).

As shown, the locking mechanism 322 is operably connected to the first handrail 306. For example, as shown, the first handrail 306 has a first end 324 and a second end 326. The first end 324 is removably attached to the first subpanel 302 and the second end 326 is rotatably attached to the first subpanel 302. Additionally, the second end 326 of the first handrail 306 is operably connected to a pivot 328 of the locking mechanism 322. In some embodiments, the second end 326 is rigidly or fixedly connected to the pivot 328. Although shown and described herein as a rotation of the handrail, other movements may be used without departing from the scope of the present disclosure. For example, in some embodiments, the handrail or a portion thereof may translate, pull out, push in, slide, or otherwise move and act upon a pivot similar to that shown and described herein.

As shown in FIG. 3B, the pivot 328 is operably connected to one or more locking pins 330*a*, 330*b*. A first locking pin 330*a* is located at the top 318 of the elevator car panel 300 and a second locking pin 330*b* is located at the bottom 316 of the elevator car panel 300. The pivot 328 is operably connected to the locking pins 330*a*, 330*b* by respective connectors 332*a*, 332*b*. The connectors, in some embodiments, are configured as rigid rods and in other embodiments are chains (e.g., monostable, springs, etc.), although other types of connectors, rigid or otherwise, may be used without departing from the scope of the present disclosure.

FIG. 3B shows the locking mechanism 322 (and the elevator car panel 300) in a first or locked position. In the first position, the first locking pin 330*a* is engaged with the ceiling 320 such that the first locking pin 330*a* retains the first subpanel 302 in a closed position at the top thereof. Similarly, in the first position, the second locking pin 330*b* is engaged with the floor 314 such that the second locking pin 330*b* retains the first subpanel 302 in a closed position at the bottom thereof. In the first position, a person cannot access the components that are behind the elevator car panel 300.

When a technician or other person desired to gain access to the elements behind the elevator car panel 300, the person can operate the locking mechanism 322 to open the elevator car panel 300 or a portion thereof. For example, as shown in FIGS. 3C-3D, an example of the operation of the locking mechanism 322 is shown. FIGS. 3C-3D show the locking mechanism 322 in the second or unlocked position, and the arrows on the figures demonstrate how the locking mechanism 322 transitions from the first position (FIGS. 3A-3B) to the second position (FIGS. 3C-3D).

As shown in FIG. 3C, the first handrail 306 is shown rotated about the second end 326, as indicated by the arrow. To achieve this, the first end 324 is detached from the first subpanel 302. For example, the first end 324 may be fastened to the first subpanel 302 by a securing mechanism 333, e.g., a fastener, which engages with an aperture 334 in the first subpanel 302. In some embodiments, the securing mechanism 333 may be screw, hidden screw, no-head screw, or other type of threaded engagement and fastening. Alternative mechanisms of securing, fastening, and/or attachment at the first end 324 can be used without departing from the scope of the present disclosure. For example, in some embodiments, the securing mechanism 333 can be configured as a key-lock type mechanism, magnetic locks, slot-pin engagements, localization pin, etc. that may be used to engage or secure the first end 324 of the first handrail 306 to the first subpanel 302.

As shown in FIG. 3D, as the first handrail 306 is rotated (e.g., FIG. 3C) the pivot 328 is rotated (as indicated by the arrows in FIG. 3D). As the pivot 328 rotates it pulls on the connectors 332*a*, 332*b*. As shown, when the pivot 328 rotates it pulls downward on the first connector 332*a* and thus pulls downward on the first locking pin 330*a*. Similarly, when the pivot 328 rotates it pulls upward on the second connector 332*b* and thus pulls upward on the second locking pin 330*b*. As shown, the first and second locking pins 330*a*, 330*b* disengage from the ceiling 320 and the floor 314, respectively, thereby unlocking the locking mechanism 322 and thus unlocking the first subpanel 302.

With the locking mechanism 322 in the second position (e.g., FIG. 3D), the elevator car panel 300 may be opened. For example, with reference to FIG. 3E, a third or open position of the elevator car panel 300 is shown. The first subpanel 302 and the second subpanel 304 may each be mounted on hinges 336 or other mechanisms that enable the subpanels 302, 304 to open outward or into the elevator car. With the elevator car panel 300 open (FIG. 3E), a technician or other person has access to various components that are housed behind the elevator car panel 300 (e.g., electronics 310*a*, 312*a*, or other components located in the elevator shaft).

After a maintenance operation, the reverse process may be performed such that the subpanels 302, 304 are closed, and the first handrail 306 can be returned to the configuration shown in FIG. 3A. By rotating the first handrail 306 from the second position (FIG. 3C) back to the first position (FIG. 3A), the pivot 328 is rotated to push the locking pins 330*a*, 330*b* to reengage with the ceiling 320 and the floor 314, respectively. With the first handrail 306 in the first position, the fastener 333 can be used to reengage the first end 324 of the first handrail 306 with the aperture 334 and thus secure the elevator car panel 300 in the first or locked position.

Those of skill in the art will appreciate that other configurations are possible without departing from the scope of the present disclosure. For example, although shown with two locking pins 330*a*, 330*b*, a single locking pin can be used. That is, one or more locking pins may be used to secure one or more parts of the elevator car panel into a locked position. Further, in some embodiments, a locking pin may be configured to secure the first subpanel 302 to the second subpanel 304. Further, although shown with the locking pins at the top and bottom, other configurations having the locking pins at the sides (or combinations thereof) are contemplated herein. Moreover, as shown, the first handrail is configured with the locking mechanism. However, in other embodiments, the second handrail may be configured with a locking mechanism similar to that described above. Further, in some embodiments, each subpanel of an elevator car panel may be configured with a locking mechanism as described herein.

Further, the operation and/or opening of the elevator car panel and/or subpanels may be different than that shown in FIGS. 3A-3E. That is, although shown in FIGS. 3A-3E with the subpanels being hinged, other configurations are contemplated and may be used without departing from the scope of the present disclosure.

Figure 4C:
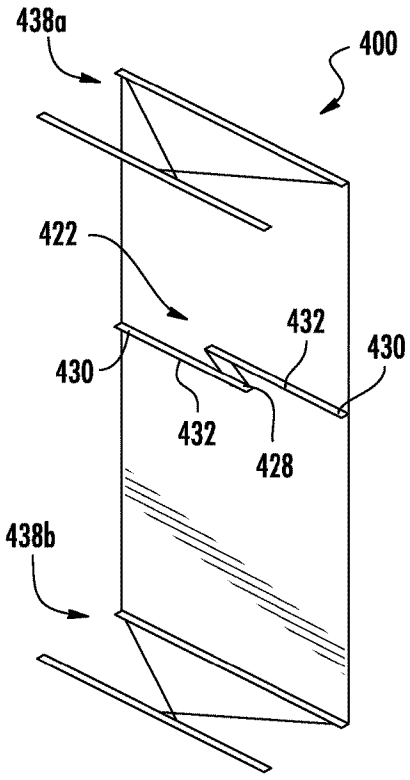
FIG. 4C is a rear perspective schematic illustration of the elevator car panel of FIG. 4A in a fully open position.
Figure 4B:
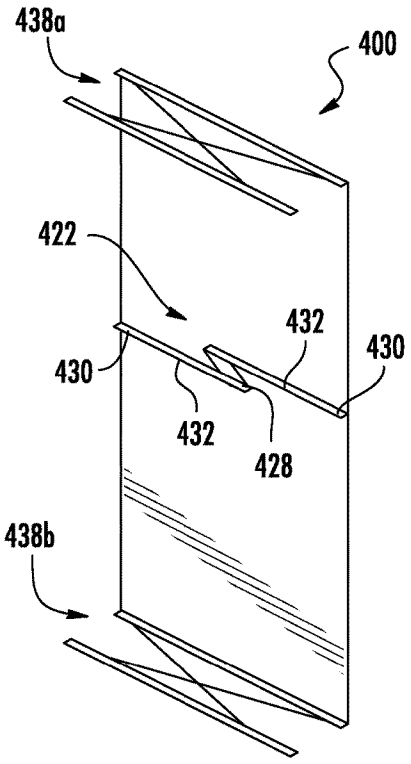
FIG. 4B is a rear perspective schematic illustration of the elevator car panel of FIG. 4A in a partially open position.
Figure 4A:
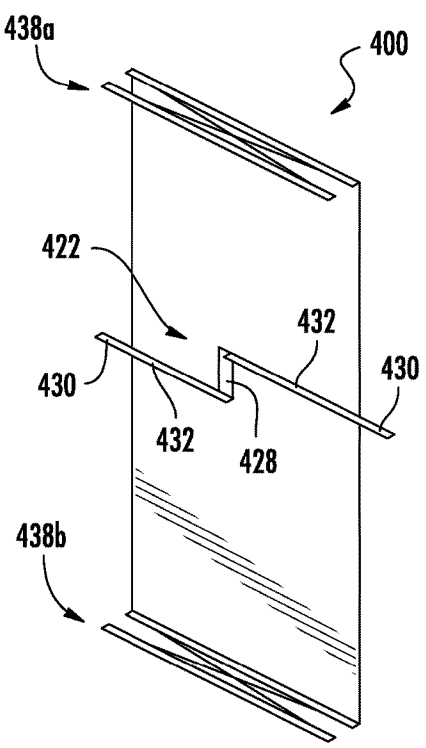
FIG. 4A is a rear perspective schematic illustration of an elevator car panel in accordance with another embodiment of the present disclosure.

For example, FIGS. 4A-4C show an alternative configuration of an elevator car panel in accordance with the present disclosure. The elevator car panel 400 may be configured as a single panel that spans a full wall of an elevator car. In this embodiment, the elevator car panel 400 is moveably mounted to a frame of the elevator car by one or more translating devices 438*a*, 438*b*. As shown, a first translating device 438*a* is configured at the top of the elevator car panel 400 and a second translating device 438*b* is configured at the bottom of the elevator car panel 400. The elevator car panel 400 also includes a locking mechanism 422 similar to that described above. However, in this embodiment, rather than locking at the top and/or bottom of the elevator car panel 400, the locking mechanism 422 engages at the sides of the elevator car panel 400.

FIG. 4A shows the elevator car panel 400 and the locking mechanism 422 in a first or locked position. When a handrail (not shown) is unlocked and rotated, a pivot 428 may rotate and act on connectors 432. As the connectors 432 move with the rotation of the pivot 428 the connectors 432 pull on locking pins 430 to disengage the locking pins 430 from a locked position or engage the locking pins 430 into the locked position. With the locking pins 430 in the unlocked position (e.g., FIGS. 4B-4C), the elevator car panel 400 may be translated or slid along the translating devices 438*a*, 438*b* such that the elevator car panel 400 is pulled outward from the wall, thus granting access to components that may be housed behind the elevator car panel 400.

Figure 5:
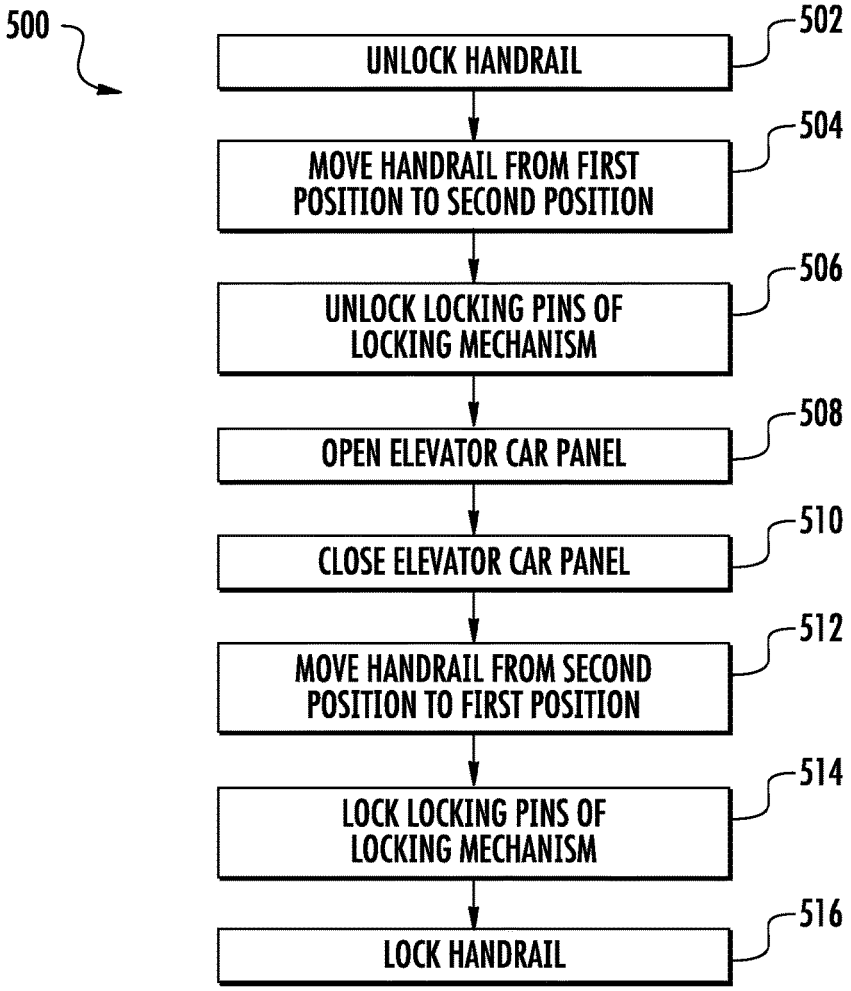
FIG. 5 is a flow process for operating and opening an elevator car panel in accordance with an embodiment of the present disclosure.

Turning now to FIG. 5, a flow process for operating and opening an elevator car panel (or portion thereof) in accordance with a non-limiting embodiment of the present disclosure is shown. The flow process may be performed by a technician, mechanic, or other person attempting to access components that are behind the elevator car panel. The elevator car panel is configured with one or more locking mechanisms and operable handrail, such as in one or more of the embodiments described above, although other configurations may employ flow process 500 without departing from the scope of the present disclosure.

At block 502, a moveable or operable handrail (such as described above) is unlocked. The unlocking may be by unscrewing a headless screw, using a key, or other operation that is configured to disengage the moveable handrail from a locked position. In some embodiments unlocking the handrail may include unfastening a fastener. When the handrail is secured it is in a locked or first position.

At block 504, the moveable or operable handrail is moved from the first position to a second position. That is, the handrail may be rotated, slid, pushed, pulled, or otherwise moved and/or actuated.

At block 506, the movement of the handrail at block 504 unlocks locking pins of a locking mechanism. The locking mechanism is configured behind the elevator car panel, and thus may be configured within a wall of the elevator car.

At block 508, with the locking pins unlocked (block 506), the elevator car panel (or a portion thereof) can be opened. Opening of the elevator car panel (or a portion thereof) enables a person to gain access to components that are behind the elevator car panel. Thus, for example, after the elevator car panel is opened, a maintenance operation may be performed.

Once the maintenance operation is complete, at block 510, the elevator car panel is closed. Then, the reverse process of opening is performed. That is, at block 512 the handrail is moved from the second position back to the first position. At block 514, as the handrail is moved in block 512, the locking pins of the locking mechanism can reengage and lock the elevator car panel. Then, at block 516, the handrail may be relocked in the first position.

As will be appreciated by those of skill in the art, although flow process 500 provides a particular order of steps, this is not intended to be limiting. For example, various steps may be performed in a different order and/or various steps may be performed simultaneously. For example, blocks 504-508 may occur substantially simultaneously such that the movement of the handrail, the unlocking of the pins, and the opening of the elevator car panel happen at substantially the same time or in one motion or operation, without departing from the scope of the present disclosure. Further, for example, blocks 510-514 may occur substantially simultaneously, in an opposite fashion.

Advantageously, embodiments described herein provide an easily openable and operable elevator car panel or subpanel that provides easy access to components behind elevator car panels from inside the elevator car. Further, advantageously, embodiments provided herein may allow for maintenance operations from inside the car (i.e., there may be no need for an operator or technician to enter an elevator shaft) because the technician may access exterior components from inside the elevator car. Moreover, advantageously, because the handrail is used to operate the locking mechanism, there is no aesthetic change to the interior of the elevator car, and specifically because of embodiments as provided herein, the handrail is not substantially affected in aesthetics and/or functionality.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although shown with various structures and configurations for the handrail and/or the locking mechanism, those of skill in the art will appreciate that other geometries, configurations, means of movement, etc. may be used without departing from the scope of the present disclosure.

Accordingly, the present disclosure is not to be seen as limited by the foregoing description, but is only limited by the scope of the appended claims.

What is claimed is:

1. An elevator car panel comprising:

a handrail configured on a first side of the elevator car panel; and a locking mechanism configured on a second side of the elevator car panel, the second side opposite the first side, wherein the handrail is operably connected to the locking mechanism such that movement of the handrail from a first position to a second position operates the locking mechanism to transition from a locked position to an unlocked position, and wherein, when in the unlocked position, the elevator car panel is openable.

2. The elevator car panel of claim 1, wherein the locking mechanism includes at least one locking pin, the locking pin configured to be engaged with a fixed portion of the elevator car when the locking mechanism is in the locked position and disengaged when the locking mechanism is in the unlocked position.

3. The elevator car panel of claim 2, further comprising a pivot operably connected to the handrail, wherein the at least one locking pin is operably connected to the pivot.

4. The elevator car panel of claim 3, further comprising a connector operably connecting the at least one locking pin to the pivot.

5. The elevator car panel of claim 1, further comprising a securing mechanism configured to secure the handrail in the first position and releasable to enable the handrail to move to the second position.

6. The elevator car panel of claim 1, further comprising an additional handrail fixedly connected to the elevator car panel.

7. The elevator car panel of claim 1:

wherein the elevator car panel includes a first subpanel and a second subpanel, wherein the handrail connected to the locking mechanism is mounted on the first subpanel, and wherein the first subpanel and the second subpanel form a wall of an elevator car.

8. The elevator car panel of claim 1, further comprising at least one hinge configured to enable the elevator car panel to open when the locking mechanism is in the unlocked position.

9. The elevator car panel of claim 1, further comprising at least one translating mechanism configured to enable the elevator car panel to open when the locking mechanism is in the unlocked position.

10. A method of opening an elevator car panel, the method comprising:

operating a handrail of an elevator car panel from a first position to a second position; and unlocking at least one locking pin of a locking mechanism operably connected to the handrail due to operation of the handrail from the first position to the second position, the at least one locking pin engageable with a fixed portion of the elevator car, wherein the handrail is on a first side of the elevator car panel and the locking mechanism is on a second side of the elevator car panel opposite the first side.

11. The method of claim 10, further comprising unlocking the handrail prior to operating the handrail from the first position to the second position.

12. The method of claim 10, further comprising opening the elevator car panel after unlocking the at least one locking pin.

13. The method of claim 10, further comprising operating the handrail from the second position back to the first position, and locking the at least one locking pin.

14. The method of claim 10, wherein operation of the handrail comprises one of rotation, pushing, pulling, or translating.

15. The method of claim 10:

wherein the elevator car panel includes a first subpanel and a second subpanel, wherein the handrail connected to the locking mechanism is mounted on the first subpanel, and wherein the first subpanel and the second subpanel form a wall of an elevator car.

* * * * *